US005394930A

United States Patent [19]

Kennerknecht

[11] Patent Number: 5,394,930

[45] Date of Patent: Mar. 7, 1995

[54] CASTING METHOD FOR METAL MATRIX COMPOSITE CASTINGS

[76] Inventor: Steven Kennerknecht, 629 Les Esables, Laval sur la Lac, Quebec, Canada

[21] Appl. No.: 154,724

[22] Filed: Nov. 19, 1993

Related U.S. Application Data

[63] Continuation of Ser. No. 765,207, Sep. 25, 1991, abandoned, which is a continuation-in-part of Ser. No. 583,623, Sep. 17, 1990, abandoned.

[51] Int. Cl.[6] ..... B22D 19/14

[52] U.S. Cl. ..... 164/112; 164/97; 164/34

[58] Field of Search ..... 164/97, 98, 91, 112, 164/122.1, 122.2, 332, 333, 34, 35

[56] References Cited

U.S. PATENT DOCUMENTS

| | | | |
|---|---|---|---|
| 3,547,180 | 12/1970 | Cochran et al. | 164/61 |
| 3,695,337 | 10/1972 | Grand | 164/55.1 |
| 4,476,916 | 10/1984 | Nusbaum | 164/23 |
| 4,770,697 | 9/1988 | Zurecki | 164/66.1 |
| 4,828,008 | 5/1989 | White et al. | 164/66.1 |
| 4,889,177 | 12/1989 | Charbonnier | 164/112 |
| 5,010,945 | 4/1991 | Burke | 164/97 |

FOREIGN PATENT DOCUMENTS

| | | | |
|---|---|---|---|
| 1202764 | 4/1986 | Canada . | |
| 0071449 | 2/1983 | European Pat. Off. | 164/97 |
| 63-180357 | 7/1988 | Japan | 164/112 |
| 63-192550 | 8/1988 | Japan | 164/98 |
| 576161 | 10/1977 | U.S.S.R. | 164/98 |

OTHER PUBLICATIONS

PCT International Publication No. WO 83/02782–International Publication Date: Aug. 18, 1983.

*Primary Examiner*—P. Austin Bradley
*Assistant Examiner*—Erik R. Puknys
*Attorney, Agent, or Firm*—McFadden, Fincham

[57] ABSTRACT

The invention discloses an improved method for forming metal matrix composite castings. The method achieves the casting having increased mechanical properties by using a selectively permeable mold in conjunction with pressurized gas. This allows a greater degree of metal infiltration within the interstices of a suspended preform. The method teaches the use of whiskered, fibered and particulated ceramic constituents for use in the preform, as well as various embodiments of casting methods.

14 Claims, 4 Drawing Sheets

CERAMIC PREFORM

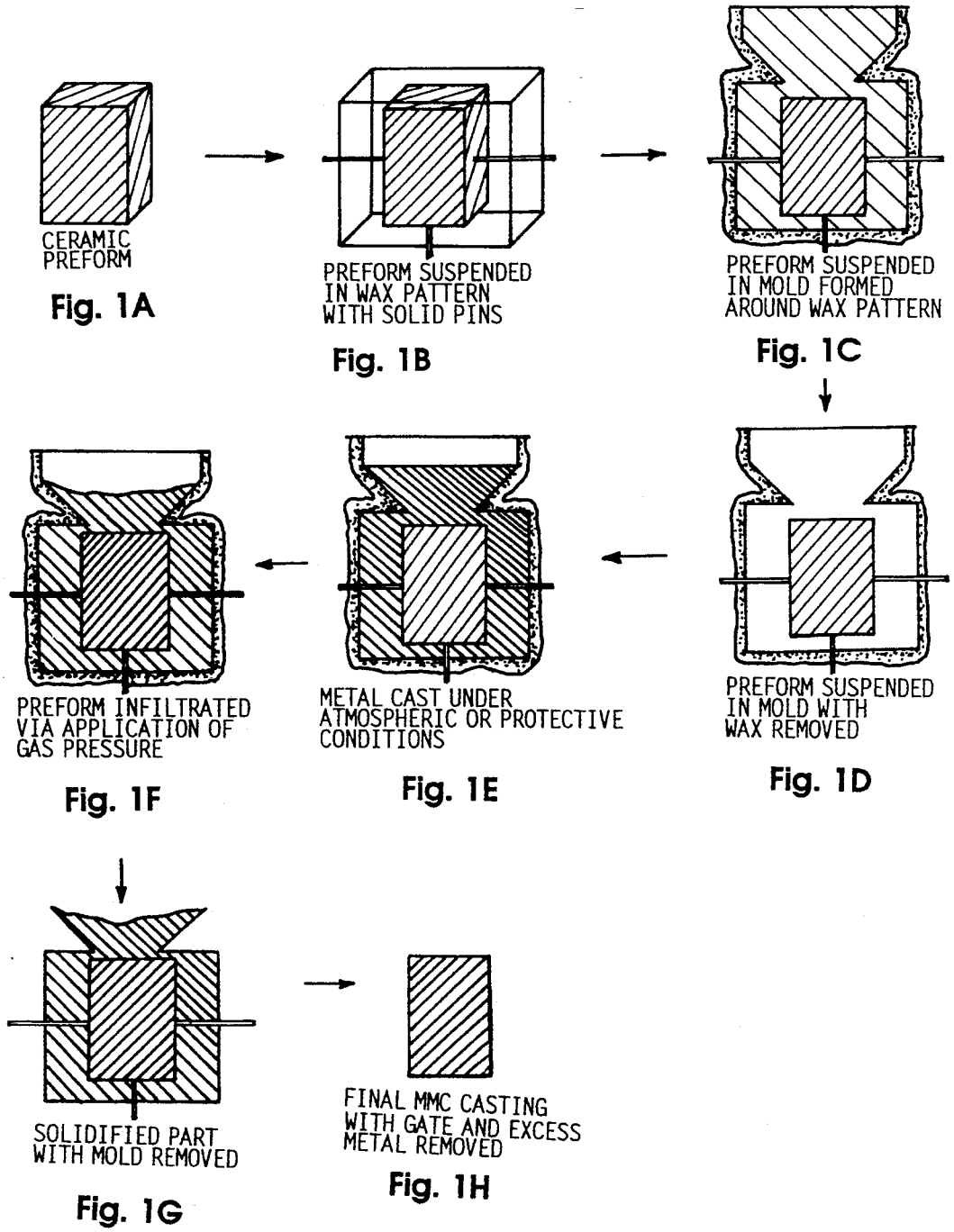
CERAMIC PREFORM
Fig. 1A
PREFORM SUSPENDED IN WAX PATTERN WITH SOLID PINS
Fig. 1B
PREFORM SUSPENDED IN MOLD FORMED AROUND WAX PATTERN
Fig. 1C
PREFORM SUSPENDED IN MOLD WITH WAX REMOVED
Fig. 1D
METAL CAST UNDER ATMOSPHERIC OR PROTECTIVE CONDITIONS
Fig. 1E
PREFORM INFILTRATED VIA APPLICATION OF GAS PRESSURE
Fig. 1F
SOLIDIFIED PART WITH MOLD REMOVED
Fig. 1G
FINAL MMC CASTING WITH GATE AND EXCESS METAL REMOVED
Fig. 1H

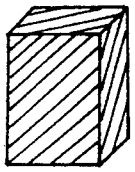

CERAMIC PREFORM

Fig. 2A

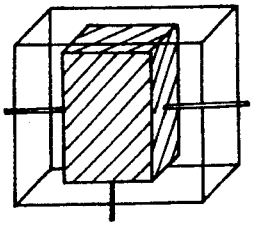

PREFORM SUSPENDED IN WAX PATTERN WITH SOLID PINS

Fig. 2B

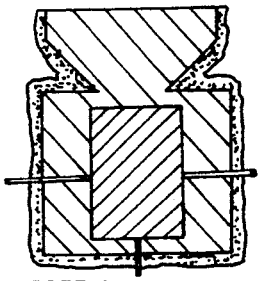

PREFORM SUSPENDED IN MOLD FORMED AROUND WAX PATTERN

Fig. 2C

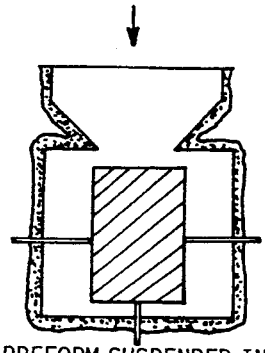

PREFORM SUSPENDED IN MOLD WITH WAX REMOVED

Fig. 2D

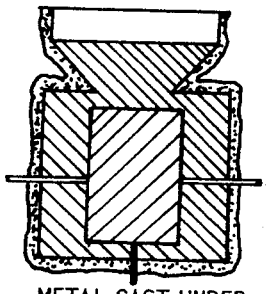

METAL CAST UNDER VACUUM INTO HEATED MOLD CONTAINING PREFORM

Fig. 2E

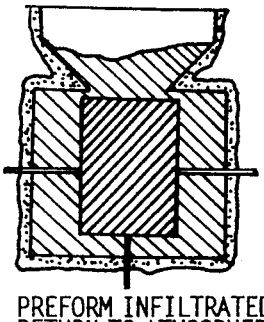

PREFORM INFILTRATED RETURN TO ATMOSPHERIC PRESS

Fig. 2F

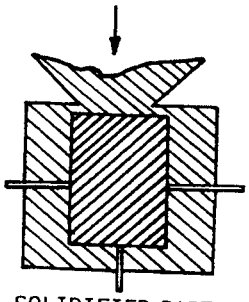

SOLIDIFIED PART WITH MOLD REMOVED

Fig. 2G

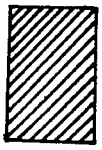

FINAL MMC CASTING WITH GATE AND EXCESS METAL REMOVED

Fig. 2H

CERAMIC PREFORM

PREFORM SUSPENDED IN WAX PATTERN WITH SOLID PINS

PREFORM SUSPENDED IN MOLD FORMED AROUND WAX PATTERN

PREFORM SUSPENDED IN MOLD WITH WAX REMOVED

METAL CAST UNDER VACUUM INTO HEATED MOLD CONTAINING PREFORM

PREFORM INFILTRATED IN VACUUM

SOLIDIFIED PART WITH MOLD REMOVED

FINAL MMC CASTING WITH GATE AND EXCESS METAL REMOVED

CERAMIC PREFORM

PREFORM WITH BARRIER SUSPENDED IN WAX PATTERN

PREFORM SUSPENDED IN MOLD FORMED AROUND WAX PATTERN

PREFORM SUSPENDED IN MOLD WITH WAX REMOVED

METAL CAST UNDER VACUUM CONDITIONS

PREFORM INFILTRATED VIA APPLICATION OF GAS PRESSURE

SOLIDIFIED PART WITH MOLD REMOVED

FINAL MMC CASTING WITH GATE AND EXCESS METAL REMOVED

CASTING METHOD FOR METAL MATRIX COMPOSITE CASTINGS

This application is a continuation of application Ser. No. 07/765,207, filed Sep. 25, 1991, now abandoned, which is a continuation-in-part of Ser. No. 07/583,623, filed Sep. 17, 1990, now abandoned.

FIELD OF THE INVENTION

This invention relates to improved methods of forming metal matrix composite castings incorporating a composite material preform.

DESCRIPTION OF THE PRIOR ART

Various methods for casting metal matrix composite material castings are known in the art. These methods include, for example, squeeze and die and permanent mold casting.

Squeeze casting, as related to die and permanent mold casting, is adequate in both infiltration and casting of composites, but is limited to size and complexity of the formed part, and temperature constraints of the die and loaded preform. In order for a significantly sized part to be cast, this technique requires enormous areas to house the massive press necessary for the process. In view of these impedances, i.e.; the temperature, pressure and size requirements, the practicality of the process is greatly limited.

Canadian Patent No. 1,202,764 describes a process for forming a reinforced casting. The process involves providing a non-metallic fibrous reinforcement which is wound around a former. The former is placed within a heated die into which molten aluminum is charged. Upon sufficient charging of the die with the alloy, the die is then pressurized with an inert gas forcing the metal to flow through the fibrous array thereby forming a metal matrix linking the fibers. The metal infiltrates the die by a hose connected to a crucible containing the alloy. The alloy travels into the die by vacuum. This method is limited to moderate quality metal matrix composites since it employs solely a fibrous reinforcement and, further does not contemplate alternate composite materials, forms thereof, ceramic volume in a cast product or other critical parameters associated with castings having superior mechanical properties.

Further, in U.S. Pat. No. 4,777,998 there is disclosed a method for forming metal matrix composites using sand molds. The major limitation of this method is the requirement for successively high temperatures and pressures. These requirements exceed practical economic boundaries for cost effective manufacturing in metallurgical industry. Additionally, as in the cast of squeeze casting, this method requires the manipulation of a super heated composite preform for transfer into a cooler die or mold, while attempting to stringently maintain control over other processing parameters.

U.S. Pat. No. 4,828,008 discloses a metallurgical process to form a ceramic reinforced aluminum matrix composite by contacting a molten aluminum-magnesium alloy with a permeable mass of ceramic material in the presence of a gas comprising 10% to 100% nitrogen, at temperatures exceeding 700° C. Under these conditions the alloy spontaneously infiltrates the ceramic mass under normal atmospheric pressures. The resulting composite material routinely contains a discontinuous aluminum nitride phase in the aluminum matrix, due to the high temperature reaction of metal and ceramic in the presence of nitrogen. A disadvantage of this process, other than the difficulty in forming complex net shape products with internal coring, is the contamination of alloy with aluminum nitride. In addition, unreinforced portions of the structure containing the unwanted nitride phase routinely exhibit very poor mechanical properties.

BRIEF SUMMARY OF THE INVENTION

The present invention provides a method for forming metal matrix composite material castings which circumvents the obstacles and limitations of the known methods, attempting to form the same. As in conventional metallurgical techniques known in the art, the preform is assembled into a wax pattern, dipped into a ceramic slurry and stuccoed, the wax is then melted and the mold fired. The resulting mold product is then used for casting. In known methods for producing metal matrix composites, such as squeeze casting, to produce the metal matrix composites the process requires enormous apparatus and temperatures and producing cast pieces with moderate metal properties.

The present invention produces high quality, mechanically sound metal matrix composites by stringent control and choice of processing parameters such as ceramic mold material choice, mold preheat temperatures, metal preheat temperature, pouring technique and environment, infiltration pressure and solidification rate.

In one embodiment of the invention a porous ceramic preform including a composite material is suspended within a selectively permeable mold. The preform may be suspended by using pins sufficiently strong to retain the preform and keep it free from contacting the mold at any location. The mold in which the preform is suspended, is preferably selectively permeable insofar as it allows gas to pass through it, but not the molten metal. The mold preferably comprises porous material e.g. plaster, ceramic grains, or powders, inorganic binders or combinations of these, as well as other materials used for investment casting molds. The preform and mold may be preheated prior to insertion into an enclosure or, alternatively while therein.

The molten metal is then cast into the mold under vacuum conditions, and a gas, e.g. helium, neon, carbon dioxide, argon etc. is introduced into the enclosure housing the mold. The pressure elevates within the enclosure and in conjunction with the porous mold, aids in forcing the molten metal between and around the interstices of the preform, thus effectively consolidating the metal therein. Additionally, the gas may be chosen for a desired cooling effect, i.e. rate of solidification in order to maximize mechanical properties of the casting.

In an alternate embodiment, the molten metal is cast into the mold under ambient conditions.

In yet another embodiment of the present invention, the porous mold having the preform therein is not freely suspended, i.e. the preform contacts the mold at a point therein. At this point, the mold or preform includes a barrier, which does not permit the molten metal to infiltrate the preform or the mold at that point. In this way, the pressurized environment within the enclosure, facilitates the flow of metal through the interstices not blocked by the barrier.

The materials comprising the preform may include, for example, alumina, alumino silicates, silicon carbide, graphite, titanium carbide, silicon titanium carbide, coated by various inorganic or organic materials, as well as metallic materials such as stainless steel, titanium etc., organic resins or any combination of these. The materials can be in the form of fibers, particulates or whiskers.

By employing these methods, superior quality metal castings can be produced having outstanding mechanical characteristics, i.e. high strength, low coefficient of thermal expansion, high hardness, low or high elastic modulus etc. It is therefore an object of this invention to provide a method achieving this goal.

It is a further object of this invention, to provide a method of producing metal matrix composite castings devoid of the requirement for extreme temperatures and excessively large apparatus.

It is another object of the present invention, to provide a method for producing composite materials wherein selected areas of the casting include differing coefficients of thermal expansion.

It is a further object of the present invention to provide a method for producing composite materials wherein selected areas of the casting are reinforced with a preform, for use in a variety of applications.

In another object of the present invention, there is provided a method for forming metal matrix composite castings which traverses the limitations of the prior art.

In still another object of the present invention there is provided a method for forming metal matrix composite castings where the final casting product can be custom engineered for various applications.

A further object of the present invention is to provide a method for forming a metal matrix composite material casting comprising:

- providing a selectively permeable mold and pressurable enclosure;
- providing a composite material which is a selectively permeable preform;
- suspending the preform within the mold by suspension means;
- pouring a molten metal into the mold while the mold is under a pressure at least approximately atmospheric pressure;
- subsequently placing the mold in the pressurized enclosure;
- providing a cooling gas and pressurizing the cooling gas in the pressurable enclosure whereby the porous preform is pressurably infiltrated with the molten metal.

A further object of the present invention provides a method for forming a metal matrix composite material casting wherein a mold having walls is placed within a pressurable enclosure, the enclosure being evacuated, the improvement comprising: providing a selectively permeable mold; providing a composite material porous preform; suspending the porous preform freely within the mold whereby the preform does not contact the walls of the mold; pouring the molten metal into the mold whereby the preform is exposed thereto; providing a cooling gas; pressurizing the gas within the enclosure whereby the preform is pressurably infiltrated with the molten metal.

It is yet another object of the present invention to provide a method for preforming a metal matrix composite material casting wherein a mold having walls, is placed within a pressurable enclosure, the enclosure being evacuated, the improvement comprising: providing a selectively permeable mold; providing a composite material porous preform; suspending the porous preform freely within the mold whereby the preform does not contact the walls of the mold; pouring the molten metal into the mold while the mold is under at least atmospheric pressure, whereby the preform is exposed thereto; providing a cooling gas; subsequently pressurizing the gas after the metal has been poured into the mold and while the mold is within the enclosure whereby the preform is pressurably infiltrated with molten metal.

Composite material investment casting generally involves incorporating ceramic material in a preform shape to be exposed to a molten alloy. The resulting casting has enhanced strength, stiffness and is lightweight.

Generally, factors involved in achieving this result include: type and form of the ceramic constituent incorporated in the preform; alloy employed in the casting process; the wettability of the molten metal with the preform, i.e. metal and preform bonding relationship; efficiency of pressure exposure to the casting; and volume fraction of the ceramic constituents within the casting.

Considering the type of ceramic constituent of the preform, a variety of materials are contemplated. These materials are generally stable at or above the desired alloy liquid temperature, and include alumina, silicon carbide, carbon, titanium carbide, alumino silicates, silicon carbide, silicon titanium carbide organic resins, metalloids, graphite or a combination thereof. The constituents are useful in several forms including the known shapes such as whiskers, particulates, and continuous fibers.

Alloys employed in the process of investment casting are diverse, including both ferrous and non-ferrous metals. The metal alloy contemplated for use includes these classes, however a preferred alloy includes aluminum as a major constituent, further including, for example, silicon, manganese, zinc, iron, magnesium, titanium, copper, chromium, beryllium, lithium, silver, strontium, vanadium, zirconium.

Considering the wettability i.e. the reaction between a molten alloy and the preform, this parameter is effected by the surface texture of the preform, and diameter of the ceramic constituent comprising the same.

Additionally, when preform samples are surrounded or dipped in wax prior to the shell building, followed by the subsequent firing and casting, the result is the evolution an oxide film on the preformed constituent surface. This film generally inhibits efficiency of this alloy-preform bond, thus resulting in poor wetting. Silicon carbide fibers are more effected by the alumina fibers. In some applications, however, it may be more advantageous to employ silicon carbide fibers rather than alumina fibers. This obstacle is overcome by reacting the preform substrate with an intermediate compound compatible with the molten alloy to produce intermediate by-products either inert or friendly to both materials. Such intermediate compounds include both group 1 and group 2 elements with a preferred group comprising lithium and magnesium in combination with the aluminum alloy.

Referring to the use of pressure efficiency, it is known that pressure coupled with the rate of solidification of a casting inherently produces finer microstructures therein. This procedure yields particular success when an inert gas such as helium, nitrogen or group VIII of the Periodic Table gases having a high coefficient of thermal extraction are used. In order for a preform to result in a quality casting, the pressure transfer thereto must be highly effective. As such, it is preferred that the preform be cast within a porous mold. A particularly preferred aspect of the present invention is that the preform be suspended within the mold using pins comprising, for example, metal, ceramic material or glass.

In terms of the mold, it is preferred that it be selectively permeable, i.e. allowing gas matter to flow therethrough but not liquid matter and that it comprise material selected from the group comprising: ceramic sand grains or powder, organic and inorganic binders, silica, zirconium silicate, zirconia, plaster, alumina, silicon carbide, alumina-silicates, graphite, organic resins, wetting agents defoamers, solvents, metalloids or any combination thereof. By suspending from within the mold, the molten metal is subjected to maximum surface area on the preform thereby resulting in sufficient consolidation of the alloy within the interstices thereof. In such an arrangement, the addition of an inert gas previously described herein results in complete peripheral infiltration of the alloy within the preform with the additional benefit of a controlled solidification rate. The introduction of the gas may occur in a sealable enclosure in which the mold and preform are situated. This is achieved isostatically. Additionally, the preform and mold may be preheated individually outside the enclosure or simultaneously therein. The preheat temperature is preferably from 400° F. (204° C.) to 2200° F. (1204° C.), with a preferred temperature of 1300° F. (704° C.). Considering the volume of ceramic constituents in the resulting casting, i.e. the percent volume of ceramic constituent based on the entire volume of the casting, the fraction plays a role in the mechanical and physical properties of the casting. Too great a volume in the casting will consequently result in depreciated mechanical properties. Similarly, an insufficient amount produces the same effect.

Reference will now be made to the following Tables, in which:

- Table 1 indicates metallurgical data showing the effect of using 25% volume fraction silicon carbide particulates on the strength of the casting.
- Table 2 indicates metallurgical data showing the effect of using 18% volume fraction of silicon carbide particulates on the strength of the casting.
- Table 3 indicates metallurgical data showing the effect of using various volume fractions of silicon carbide whiskers.
- Table 4 indicates metallurgical data illustrating the effect on strength using high volume fraction silicon carbide particulates.

Tables 1 through 3 indicate data showing the effect of ceramic constituent form and type on the mechanical properties including tensile yield, elongation and modulus. Where superior strength is not a critical feature, the higher volume fraction of ceramic constituent produces a casting with an outstanding coefficient of thermal expansion approaching that of titanium. This provides a casting particularly well suited for hermetic housings, integrated circuits, electroptical housings and platforms, mirror substrates, optical components for space applications, generally for electronic housing. Table 4 illustrates data showing the depreciated strength of high volume ceramic content. The result, however is a casting with the highly desirable low coefficient of thermal expansion. In a preferred volume the ceramic constituent comprises from about 15% to 85% with a preferred range of 17% to about 65%.

TABLE 1

PROPERTIES OF HIGHLY LOADED ALUMINUM ALLOY MMCs

| Matrix | Preform | Tensile Strength Ksi (MPa) | Elastic Modulus Msi (GPa) | Elongation Percent | CTE | in/in*F(m/m*K) |
|---|---|---|---|---|---|---|
| A357 | 0 | 45 (310) | 10 (67) | 4.0 | 12 | 22 |
| 6061 | 0 | 45 (310) | 10 (67) | 12.0 | 13 | 23 |
| A357 | 45% SiC | 45 (310) | 24 (165) | 0.4 | 17 | 9 |
| A357 | 65% SiC | 35 (241) | 28 (193) | 0.3 | 12 | 7 |
| 6061 | 45% SiC | 40 (275) | 22 (151) | 0.1 | 18 | 10 |
| 6061 | 65% SiC | 32 (220) | 25 (172) | 0.1 | 13 | 7 |

Conditions:
cast in vacuum
Enclosure pressure 1000 psi

The data illustrated above indicate that with the inclusion of a silicon carbide preform a significant increase in the elastic modulus of the metal matrix casting is achieved. Additionally, a better coefficient of thermal expansion is achieved in certain cases.

TABLE 2

PROPERTIES OF WHISKER REINFORCED ALUMINUM MMCs

| Matrix | Preform | Tensile Strength Ksi (MPa) | Elastic Modulus Msi (GPa) | Elongation Percent |
|---|---|---|---|---|
| A357 | 0 | 45 (310) | 10 (67) | 4.0 |
| 6061 | 0 | 45 (310) | 10 (67) | 12.0 |
| A357 | 18% SiC | 49 (337) | 7 (48) | 1.5 |
| 6061 | 18% SiC | 50 (344) | 8 (55) | 1.4 |

Conditions:
Cast in ambient environment
Enclosure pressure 1000 psi

It can be concluded from the above data that even a low volume fraction i.e. 18% of the preform provides moderate increases in metal matrix casting tensile strength.

TABLE 3

PROPERTIES OF SHORT ALUMINA FIBER REINFORCED ALUMINUM MMCs

| Matrix | Preform | Tensile Strength Ksi (MPa) | Elastic Modulus Msi (GPa) | Elongation Percent |
|---|---|---|---|---|
| A357 | 0 | 45 (310) | 10 (67) | 4.0 |
| 6061 | 0 | 45 (310) | 10 (67) | 12.0 |
| A357 | 20% Zircar | 46 (317) | 11 (76) | 1.1 |
| 6061 | 20% Zircar | 47 (324) | 12 (83) | 1.5 |
| A357 | 20% Saffil | 35 (241) | 8 (55) | 0.9 |
| 6061 | 20% Saffil | 33 (227) | 7 (48) | 0.8 |

Conditions:
Cast in vacuum
Enclosure pressure 900 psi

It can be concluded from the above data that even a low volume fraction i.e. 20% of the preform provides moderate increases in metal matrix casting tensile strength as compared to castings devoid of a preform constituent.

TABLE 4

PROPERTIES OF CONTINUOUS FIBER REINFORCED ALUMINUM MMCs

| Matrix | Preform | Tensile Strength Ksi (MPa) | Elastic Modulus Msi (GPa) | Elongation Percent |
|---|---|---|---|---|
| A357 | 0 | 45 (310) | 10 (67) | 4.0 |
| 6061 | 0 | 45 (310) | 10 (67) | 12.0 |
| A357* | 20% SiC | 90 (620) | 28 (193) | 0.3 |
| 6061* | 20% SiC | 83 (572) | 19 (131) | 1.0 |
| A357 | 20% Alumina | 40 (276) | 9 (62) | 1.0 |
| 6061 | 20% Alumina | 39 (269) | 9 (62) | 0.9 |
| A357 | 20% SiC | 55 (379) | 14 (96) | 0.2 |

Note:
Samples marked with an * denote reducing atmosphere used
Conditions:
Cast in vacuum
Enclosure pressure 1000 psi
Normal preheating atmosphere (with exceptions below)

Once again, the data illustrate that various preform constituents produce notable increases in both elastic modules and tensile strength.

The data illustrated collectively above, indicate that superior mechanical properties can be achieved in forming metal matrix composite castings when such a casting is formed according to the process of the present invention.

Having thus generally described the invention, reference will now be made to the accompanying drawings, illustrating preferred embodiments.

BRIEF DESCRIPTION OF THE DRAWINGS

FIGS. 1A–1H illustrate diagrammatic representation of a preferred sequence of events in one embodiment according to the present invention;

FIGS. 2A–2H illustrate diagrammatic representation of a preferred sequence of events in an alternate embodiment of the present invention;

DETAILED DESCRIPTION OF THE PREFERRED EMBODIMENTS

Referring generally to FIGS. 1A through 3H, the prepared preform is surrounded with a layer of wax and assembled into a desired pattern for dipping into the ceramic. In order to suspend the ceramic preform after dewaxing it is preferred that the stainless steel pins be pressed through the wax walls into the preform. The shell is then fired at 1400° F. and cast; the preferred metal being the above-described aluminum alloy.

Referring specifically to FIG. 1A–1H, there is shown a diagrammatic representation of the preferred sequence of events.

Initially the preform and FIG. 1A shell are heated to a temperature of approximately 400° F. (204° C.) to 2200° F. (1204° C.) with a preferred temperature of 1300° F. (704° C.). The heated preform is freely suspended in order that it does not contact the walls or base of the mold, using stainless steel pins within the porous mold. The mold as shown in FIG. 1B preferably comprises a constituent selected from the group comprising: ceramic sand grains and powders, plaster, organic and inorganic binders, silica, zirconium silicate, zirconia, silicon carbide, carbon, organic resins, alumina, alumino silicates, wetting agents, defoamers, solvents or any combination thereof. The mold is heated to a temperature of approximately 400° F. (204° C.) to 2200° F. (1204° C.) with a preferred temperature of 1300° F. (704° C.). The mold containing a suspended preform is then placed within a preferably sealable enclosure. The molten metal is poured within the mold under ambient conditions. The enclosure is then sealed and evacuated as generally illustrated in FIGS. 1C, 1D and 1E. The enclosure subsequently then is pressurized with an inert gas preferably selected from the group comprising: nitrogen, helium, a group VIII gas of the Periodic Table, or fluorinated of chlorinated compounds thereof. The mold, being selectively permeable, allows pressurable infiltration of the molten metal alloy within the interstices of the porous preform. This is illustrated generally in FIGS. 1F, 1G and 1H.

In an alternate embodiment such as that illustrated in FIGS. 2A–2H many of the steps of which are common with FIGS. 1A–1H, the molten metal is poured into the mold containing the preform under vacuum conditions, after which the cast mold is returned to atmospheric pressure facilitating competition of the infiltration process as illustrated in FIG. 2E.

In another embodiment as diagrammed in FIGS. 3A–3H, the porous preform is suspended within the mold by stainless steel pins. The molten metal is then poured, under vacuum, into the enclosure containing a preform and a cooling gas preferably such as those herein previously described. The interstitial areas of the preform are infiltrated with the molten metal under vacuum conditions.

Figure 3A:
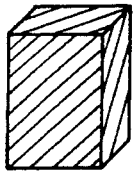
FIGS. 3A–3H illustrate diagrammatic representation of a preferred sequence of events in a further embodiment according to the present invention.
Figure 3B:
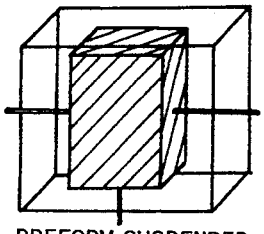
Figure 3C:
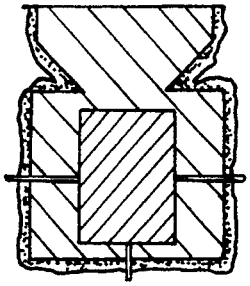
Figure 3D:
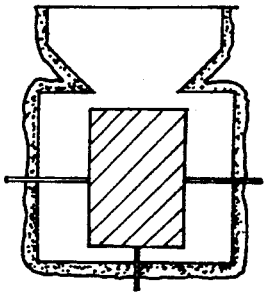
Figure 3E:
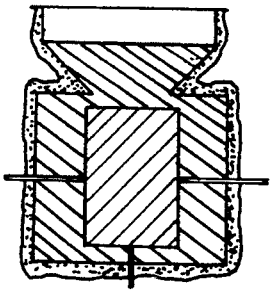
Figure 3F:
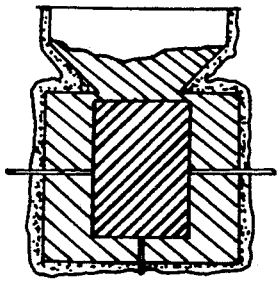
Figure 3G:
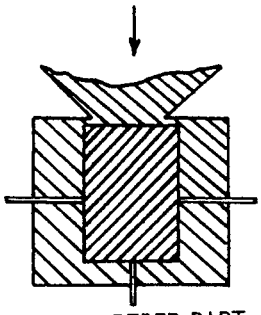
Figure 3H:
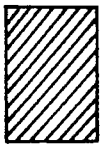
Figure 4A:
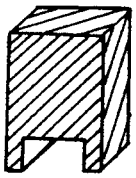
FIGS. 4A–4H illustrate diagrammatic representation of a preferred sequence of events in yet another embodiment according to the present invention.
Figure 4B:
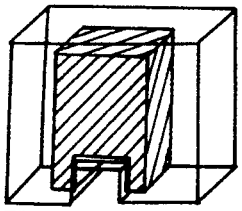
Figure 4C:
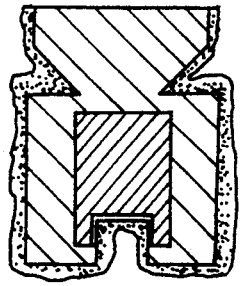
Figure 4D:
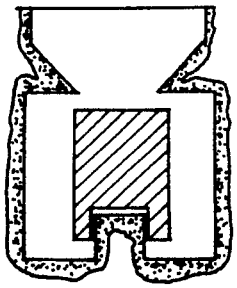
Figure 4E:
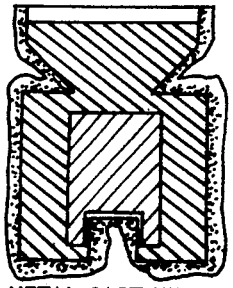
Figure 4F:
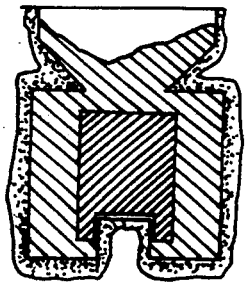
Figure 4G:
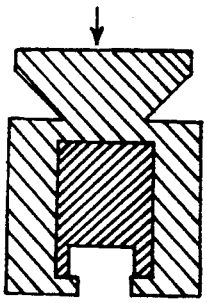
Figure 4H:
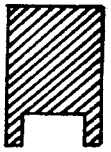

FIGS. 4A–4H shows a preferred sequence of events wherein a barrier shown in FIG. 4B is employed in the casting procedure. The barrier preferably comprises an insoluble material with a melting point above that of the alloy used in the casting process. The barrier may be integral with the preform or, alternatively, may be fixed to the interior surface of the permeable mold. In such a method of forming metal matrix composite castings, a portion of the surface of a casting is left unexposed to molten metal, which allows for innumerable shapes and configurations of castings to be formed. FIGS. 4A–4H illustrate the preferred sequence of events. The preform is positioned within the mold and preferably in contact with the surface of the barrier as shown in FIGS. 4A through 4D. The molten metal is then poured into the selectively permeable mold. A gas, preferably those described previously herein, is introduced into the enclosure housing the mold, barrier and preform. As the pressure increases within the enclosure, the molten metal is forced into the preform thereby infiltrating the surface and interior thereof with the exception of the barrier portion these steps are broadly shown in FIGS. 4E through 4H.

As those skilled in the art would realize, these preferred illustrated details can be subjected to substantial variation, without affecting the function of the illustrated embodiments.

Although embodiments of the invention have been described above, it is not limited thereto and it will be apparent to those skilled in the art that numerous modifications form part of the present invention insofar as they do not depart from the spirit, nature and scope of the claimed described invention.

I claim:

1. A method for forming a reinforced metal matrix composite material casting comprising:

providing a selectively gas permeable mold and pressurable enclosure;

providing a composite material which is a selectively permeable preform for reinforcing said casting;

suspending said preform within said mold by suspension means to maintain a clearance between said preform and said mold for at least a major part of the periphery of the preform;

heating said mold and preform;

substantially surrounding said preform with molten metal by pouring said molten metal into said mold while said mold is at approximately atmospheric pressure;

subsequently placing said mold in said pressurable enclosure;

providing a cooling gas and pressurizing said cooling gas in said pressurable enclosure whereby the molten metal is pressurized through said mold and said porous preform is pressurably infiltrated with said molten metal.

2. The method as defined in claim 1, wherein said selectively permeable preform includes at least one ceramic component.

3. The method as defined in claim 1, wherein said preform includes at least one compound selected from the group comprising: alumina, silicon carbide, graphite, alumino silicates, organic resins, or a combination thereof.

4. The method as defined in claim 1, wherein said preform includes compounds in a form selected from the group comprising: fibers, whiskers, particulates, or a combination thereof.

5. The method as defined in claim 1, wherein said molten metal is an alloy.

6. The method as defined in claim 5, wherein said alloy includes aluminum.

7. The method as defined in claim 1, wherein said permeable mold comprises a material selected from a group comprising: plaster, ceramic sand grains, ceramic powders, alumino silicates, organic resins, organic and inorganic binders, alumina, zirconium silicate, zirconia, silicon carbide, carbon, wetting agents, defoamers, solvents, or a combination thereof.

8. A method as defined in claim 1, wherein said cooling gas is selected from the group comprising: nitrogen, helium and carbon dioxide.

9. The method as defined in claim 1, wherein said cooling gas is a group VIII gas of the Periodic Table.

10. The method as defined in claim 1, wherein said suspension means comprises rigid pins.

11. The method as defined in claim 10, wherein said rigid pins comprise a material selected from the group comprising: metals, ceramics, or glass.

12. A method as defined in claim 1, wherein said cooling gas is pressurized from approximately 10 PSI to about 15,000 PSI.

13. The method as defined in claim 2, wherein said ceramic component comprises from about 15% to about 85% by volume of the said preforms.

14. The method as defined in claim 13, wherein said ceramic component comprises from about 17% to about 65% by volume of said preforms.

* * * * *